US011976653B2

(12) United States Patent
Teshima et al.

(10) Patent No.: US 11,976,653 B2
(45) Date of Patent: May 7, 2024

(54) SCROLL COMPRESSOR WITH SUPPRESSED REDUCTION OF ROTATIONAL MOMENT

(71) Applicant: SANDEN CORPORATION, Isesaki (JP)

(72) Inventors: Atsuo Teshima, Isesaki (JP); Taizo Sato, Isesaki (JP); Tetsuya Imai, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 0 days.

(21) Appl. No.: 18/256,908

(22) PCT Filed: Nov. 19, 2021

(86) PCT No.: PCT/JP2021/042520
§ 371 (c)(1),
(2) Date: Jun. 9, 2023

(87) PCT Pub. No.: WO2022/130893
PCT Pub. Date: Jun. 23, 2022

(65) Prior Publication Data

US 2024/0026882 A1 Jan. 25, 2024

(30) Foreign Application Priority Data

Dec. 17, 2020 (JP) ..... 2020-209024

(51) Int. Cl.
*F04C 18/02* (2006.01)
*F01C 17/06* (2006.01)
*F04C 29/12* (2006.01)

(52) U.S. Cl.
CPC ..... *F04C 18/0215* (2013.01); *F04C 18/0261* (2013.01); *F04C 29/12* (2013.01); *F01C 17/06* (2013.01)

(58) Field of Classification Search
CPC .. F04C 18/0215; F04C 18/0261; F04C 29/12; F01C 17/06
(Continued)

(56) References Cited

U.S. PATENT DOCUMENTS 4,365,941 A * 12/1982 Tojo ..... F25B 31/008 417/372
2004/0071571 A1* 4/2004 Uchida ..... F04C 27/005 417/410.5
2023/0167821 A1* 6/2023 Busch ..... F04C 29/12 418/55.1

FOREIGN PATENT DOCUMENTS

JP 05-288166 A 11/1993
JP 07-259756 A 10/1995
JP 2015-059517 A 3/2015

OTHER PUBLICATIONS

Japan Patent Office, International Search Report issued in International Patent Application No. PCT/JP2021/042520, mailed Jan. 11, 2022.

* cited by examiner

*Primary Examiner* — J. Todd Newton
(74) *Attorney, Agent, or Firm* — Baker Botts L.L.P.

(57) ABSTRACT

A spiral orbiting wrap of an orbiting scroll is meshed with a spiral fixed wrap of a fixed scroll. A first compression chamber is formed by an inner wall surface of the orbiting wrap and an outer wall surface of a fixed wrap. A second compression chamber is formed by an inner wall surface of the fixed wrap and an outer wall surface of the orbiting wrap. The orbiting base plate of the orbiting scroll includes a first through hole capable of communicating the first compression chamber with the back pressure chamber and a second through hole capable of communicating the second compression chamber with the back pressure chamber. The first
(Continued)

compression chamber communicates with the back pressure chamber via the first through hole prior to the communication of the second compression chamber with the back pressure chamber via the second through hole.

8 Claims, 10 Drawing Sheets

(58) Field of Classification Search
USPC ..... 418/55.1
See application file for complete search history.

SCROLL COMPRESSOR WITH SUPPRESSED REDUCTION OF ROTATIONAL MOMENT

CROSS-REFERENCE TO RELATED APPLICATIONS

This application is a U.S. National Stage Patent Application under 37 U.S.C. § 371 of International Patent Application No. PCT/JP2021/042520, filed on Nov. 19, 2021, which claims the benefit of Japanese Patent Application No. JP 2020-209024, filed on Dec. 17, 2020, the disclosures of each of which are incorporated herein by reference in their entirety.

TECHNICAL FIELD

The present invention relates to a scroll compressor that is used, for example, in an air conditioner for a vehicle.

BACKGROUND ART

The scroll compressor disclosed in Patent Document 1 includes a scroll unit including a fixed scroll and an orbiting scroll (movable scroll), and an anti-rotation mechanism that prevents the rotation of the orbiting scroll. Each of the fixed scroll and the orbiting scroll is configured such that a spiral wrap is erected on a base plate (bottom plate), and the center of the base plate and the center (spiral center) of the base circle of the wrap are eccentric from each other; and a sealed space is formed in the scroll unit by meshing the fixed scroll with the orbiting scroll such that the wraps of the fixed and orbiting scrolls face each other. The volume of the sealed space is changed by revolving the orbiting scroll around the axial center of the fixed scroll while preventing the rotation of the orbiting scroll with the anti-rotation mechanism. Patent Document 1 discloses that the anti-rotation mechanism is implemented by a circular hole formed on a back surface of the base plate of the orbiting scroll and a pin that protrudes from a housing wall facing the back surface of the base plate of the orbiting scroll and engages with the circular hole. Patent Document 1 also discloses that a rotational moment occurs in the orbiting scroll because of a compression reaction force resulting from the compression of the scroll compressor, and a load caused by the rotational moment is applied to the anti-rotation mechanism.

REFERENCE DOCUMENT LIST

Patent Document

Patent Document 1: JP 2015-059517 A

SUMMARY OF THE INVENTION

Problem to be Solved by the Invention

The inventors of the present invention, however, have discovered a phenomenon that during the operation of the scroll compressor as described above, the rotational moment momentarily disappears, and as a result, the pin momentarily moves away from the inner peripheral surface of the circular hole and then collides again with the inner peripheral surface of the circular hole.

An object of the present invention is thus to suppress the reduction of a rotational moment that occurs in an orbiting scroll.

Means for Solving the Problem

According to an aspect of the present invention, a scroll compressor is provided. This scroll compressor includes a fixed scroll including a fixed base plate having a discharge hole in the center of the fixed base plate and a spiral fixed wrap erected on the fixed base plate, an orbiting scroll including an orbiting base plate and a spiral orbiting wrap that is erected on the orbiting base plate and is meshed with the fixed wrap, a first compression chamber formed by an inner wall surface of the orbiting wrap and an outer wall surface of the fixed wrap, a second compression chamber formed by an inner wall surface of the fixed wrap and an outer wall surface of the orbiting wrap, an anti-rotation mechanism that prevents the rotation of the orbiting scroll, and a back pressure chamber formed on a back surface side of the orbiting scroll. The scroll compressor is configured such that the orbiting scroll is caused to revolve around the axial center of the fixed scroll while the rotation of the orbiting scroll is prevented by the anti-rotation mechanism to change the volume of the first compression chamber and the volume of the second compression chamber and thereby cause a fluid in the first compression chamber and a fluid in the second compression chamber to be compressed separately and then discharged together through the discharge hole into a discharge chamber. The orbiting base plate includes a first through hole capable of connecting the first compression chamber and the back pressure chamber and a second through hole capable of connecting the second compression chamber and the back pressure chamber. The first compression chamber communicates with the back pressure chamber via the first through hole prior to the communication of the second compression chamber with the back pressure chamber via the second through hole.

Effects of the Invention

According to the present invention, the pressure in the first compression chamber can be maintained higher than the pressure in the second compression chamber. This makes it possible to correspondingly increase a rotational moment generated in the orbiting scroll and thereby makes it possible to suppress reduction of rotational moment.

MODE FOR CARRYING OUT THE INVENTION

Hereinafter, an embodiment of the present invention will be described with reference to the accompanying drawings.

Figure 1:
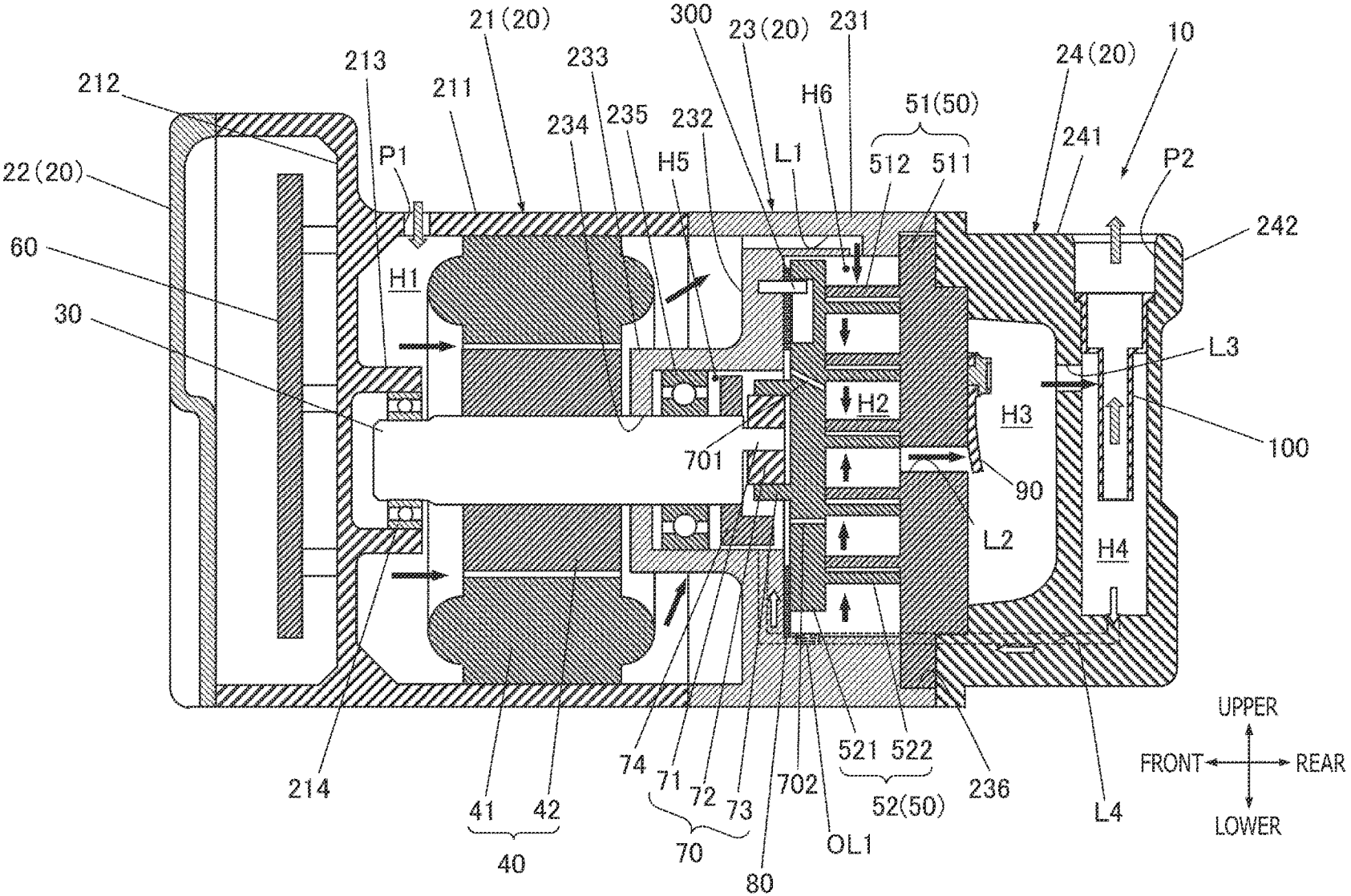
FIG. 1 is a sectional view illustrating a schematic structure of a scroll compressor according to an embodiment of the present invention.

FIG. 1 is a sectional view illustrating a schematic structure of a scroll compressor 10 according to an embodiment of the present invention. The scroll compressor 10 is incorporated in a refrigerant circuit, for example, in an air conditioner for a vehicle. Upon receiving low-pressure gaseous refrigerant from the refrigerant circuit, the scroll compressor 10 compresses this low-pressure gaseous refrigerant into high-pressure gaseous refrigerant, and returns the high-pressure gaseous refrigerant to the refrigerant circuit. The left side in FIG. 1 corresponds to the front side of the scroll compressor 10, the right side in FIG. 1 corresponds to the rear side of the scroll compressor 10, the upper side in FIG. 1 corresponds to the upper side of the scroll compressor 10, and the lower side in FIG. 1 corresponds to the lower side of the scroll compressor 10. The aforementioned gaseous refrigerant is an example of a fluid in the present invention.

The scroll compressor 10 includes a housing 20, a rotary shaft 30, an electric motor 40 that rotates the rotary shaft 30, a scroll unit 50 that is driven by the rotary shaft 30 and compresses the (low-pressure) gaseous refrigerant, and an inverter 60 that drives and controls the electric motor 40. The rotary shaft 30, the electric motor 40, the scroll unit 50, and the inverter 60 are stored in the housing 20. In addition, the scroll unit 50 includes a fixed scroll 51 and an orbiting scroll 52 that revolves with respect to the fixed scroll 51. The fixed scroll 51 and the orbiting scroll 52 are disposed facing each other in a central axis direction of the scroll compressor 10.

The housing 20 includes a front housing 21, a cover member 22, a center housing 23, and a rear housing 24. The housing 20 of the scroll compressor 10 is formed by fastening these housing members to each other, for example, with at least one fastening member (not shown).

The front housing 21 has a cylindrical shaped first peripheral wall portion 211 that extends in a front-rear direction and a first partition wall portion 212 that partitions the inside of the first peripheral wall portion 211 into front and rear portions. A front end surface of the first peripheral wall portion 211 constitutes a front end surface of the front housing 21, and a rear end surface of the first peripheral wall portion 211 constitutes a rear end surface of the front housing 21. In the present embodiment, the inside of the first peripheral wall portion 211 (that is, an internal space of the front housing 21) is partitioned by the first partition wall portion 212 into a front-side inverter storage space storing the inverter 60 and a rear-side motor storage space storing the electric motor 40. That is, the electric motor 40 and the inverter 60 are stored in the front housing 21.

The first partition wall portion 212 has a supporting portion 213 that supports a front end portion of the rotary shaft 30. Specifically, in the present embodiment, the supporting portion 213 is formed to protrude in a cylindrical shape into the motor storage space from a rear-side surface of the first partition wall portion 212. The supporting portion 213 rotatably supports the front end portion of the rotary shaft 30 via a first bearing 214 mounted inside the supporting portion 213.

The cover member 22 is bonded to the front end surface of the front housing 21, thereby closing the inverter storage space (forming an inverter storage chamber). The rear end surface of the front housing 21 is bonded to a front end surface of the center housing 23. Sealing members may be disposed between the front housing 21 and the cover member 22 and between the front housing 21 and the center housing 23, as necessary.

The center housing 23 has a cylindrical shaped second peripheral wall portion 231 that extends in the front-rear direction and a second partition wall portion 232 that partitions the inside of the second peripheral wall portion 231 into front and rear portions. A front end surface of the second peripheral wall portion 231 constitutes the front end surface of the center housing 23, and a rear end surface of the second peripheral wall portion 231 constitutes a rear end surface of the center housing 23. In the present embodiment, the inside of the second peripheral wall portion 231 (that is, an internal space of the center housing 23) is partitioned by the second partition wall portion 232 into a front-side connection space that connects to the motor storage space of the front housing 21 and a rear-side scroll storage space that stores the scroll unit 50. That is, the scroll unit 50 is stored in the center housing 23.

The second partition wall portion 232 has a hollow projection portion 233 that protrudes toward the front housing 21 (the motor storage space). The hollow projection portion 233 is formed at a radially center portion of the second partition wall portion 232 so as to face the supporting portion 213 formed on the first partition wall portion 212 of the front housing 21. The top portion of the hollow projection portion 233 has an insertion hole 234 that penetrates the hollow projection portion 233 and into which the rear end portion of the rotary shaft 30 is inserted. In addition, a second bearing 235 that rotatably supports the rear end portion of the rotary shaft 30 is attached to the inside of the hollow projection portion 233. That is, in the present embodiment, the rotary shaft 30 is rotatably supported by the first bearing 214 provided at the front housing 21 side and the second bearing 235 provided at the center housing 23 side.

The rear end surface of the center housing 23 is bonded to a front end surface of the rear housing 24. In the present embodiment, a concave portion 236 for storing an outer edge portion of a fixed base plate 511 of the fixed scroll 51 constituting the scroll unit 50 is formed on the rear end surface of the center housing 23, that is, on the rear end surface of the second peripheral wall portion 231. The outer edge portion of the fixed base plate 511 of the fixed scroll 51 is sandwiched by the center housing 23 and the rear housing 24. The fixed scroll 51 is thereby fixed, and a rear-side opening of the second peripheral wall portion 231 is closed by the fixed base plate 511 of the fixed scroll 51. A sealing member may be disposed between the center housing 23 and the rear housing 24, as necessary.

The rear housing 24 has a bottomed cylindrical shape and has a cylindrical shaped third peripheral wall portion 241 that extends in the front-rear direction and a bottom wall portion 242 that closes a rear-side opening of the third peripheral wall portion 241. A front end surface of the third peripheral wall portion 241 that constitutes the front end surface of the rear housing 24 is bonded to the rear end surface of the second peripheral wall portion 231 that constitutes the rear end surface of the center housing 23. A front-side opening of the third peripheral wall portion 241 is thereby closed by the fixed base plate 511 of the fixed scroll 51.

The electric motor 40 is, for example, a three-phase alternating current motor, and includes a stator core unit 41 and a rotor 42.

The stator core unit 41 is fixed to an inner peripheral surface of the first peripheral wall portion 211 of the front housing 21. The inverter 60 converts a direct current from, for example, an on-board battery (not shown) into an alternating current, and supplies this alternating current to the stator core unit 41.

The rotor 42 is disposed radially inside the stator core unit 41 with a predetermined gap therebetween. A permanent magnet is embedded in the rotor 42. The rotor 42 is formed in a cylindrical shape and has a hollow portion into which the rotary shaft 30 is inserted. The rotor 42 is fixed to the rotary shaft 30 with the rotary shaft 30 being inserted in the hollow portion. That is, the rotor 42 is integrated with the rotary shaft 30.

When the inverter 60 supplies power to the electric motor 40, a magnetic field is generated in the stator core unit 41. Accordingly, rotary power is applied to the permanent magnet of the rotor 42, and the rotor 42 rotates. As a result, the rotary shaft 30 rotates.

As described above, the scroll unit 50 includes the fixed scroll 51 and the orbiting scroll 52 that revolves with respect to the fixed scroll 51.

The fixed scroll 51 has a disk-shaped fixed base plate 511 and a spiral fixed wrap 512 erected on one surface of the fixed base plate 511. In the fixed scroll 51 according to the present embodiment, the spiral fixed wrap 512 is erected integrally on the fixed base plate 511. The fixed wrap 512 extends in a spiral shape from a radially inner end portion (winding start end) to a radially outer end portion (winding terminal end) 51*c* (see FIG. 7) on the one surface of the fixed base plate 511. In addition, in a state in which the one surface (the surface on which the fixed spiral wall 512 is erected) of the fixed base plate 511 faces forward, the outer edge portion of the fixed base plate 511 is fixedly sandwiched by the center housing 23 and the rear housing 24, and the fixed scroll 51 is thereby fixed.

Figure 2:
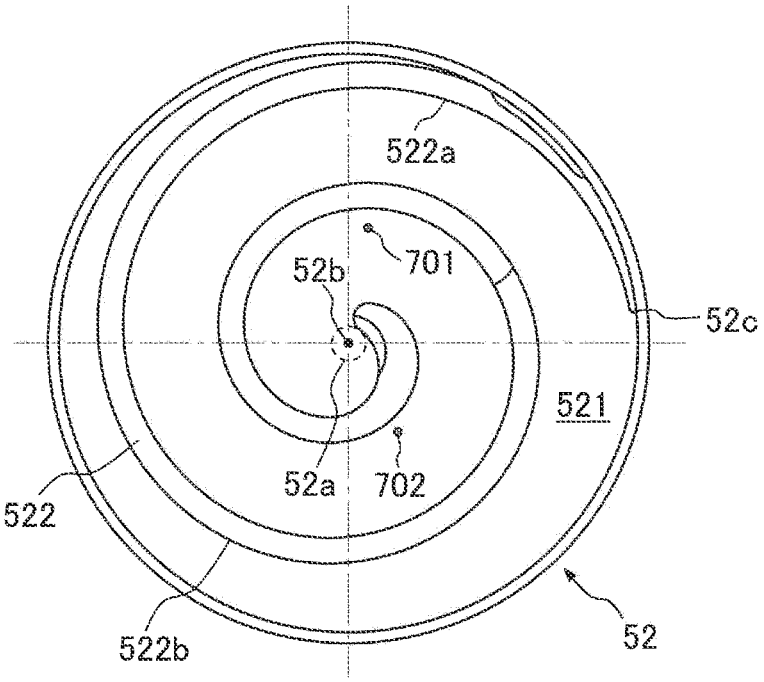
FIG. 2 is a plane view of an orbiting scroll.

FIG. 2 is a plane view of an orbiting scroll 52. As illustrated in FIGS. 1 and 2, the orbiting scroll (movable scroll) 52 has a disk-shaped orbiting base plate (movable base plate) 521 and an orbiting wrap (movable wrap) 522 erected on one surface of the orbiting base plate 521. In the orbiting scroll 52 according to the present embodiment, the spiral orbiting wrap 522 is erected integrally on the orbiting base plate 521. The orbiting wrap 522 extends in a spiral shape from a radially inner end portion (winding start end) to a radially outer end portion (winding terminal end) 52*c* on the one surface of the orbiting base plate 521. In addition, the orbiting scroll 52 is disposed such that the orbiting wrap 522 engages with the fixed wrap 512 of the fixed scroll 51. That is, the orbiting scroll 52 is disposed between the second partition wall portion 232 of the center housing 23 and the fixed scroll 51, and the one surface of the orbiting base plate 521 (the surface on which the orbiting wrap 522 is erected) faces backward. The fixed scroll 51 and the orbiting scroll 52 are disposed such that the fixed wrap 512 engages with the orbiting wrap 522, specifically, such that a protruding end of the fixed wrap 512 contacts the orbiting base plate 521, and a protruding end of the orbiting wrap 522 contacts the fixed base plate 511. A tip seal is provided on each of the protruding end of the fixed wrap 512 and the protruding end of the orbiting wrap 522.

In the present embodiment, as shown in FIG. 2, the orbiting wrap 522 is formed along an involute curve (virtual line) extending from a base circle (virtual circle) 52*a*. Here, an involute angle of the orbiting wrap 522 indicates an angle that is around a center (fixed spiral center) 52*b* of the base circle 52*a*, that is, an angle from a reference point (start point of the involute curve) on the base circle 52*a* to the winding terminal end 52*c* of the orbiting wrap 522.

Although not illustrated, similarly to the orbiting wrap 522, the fixed wrap 512 is formed along an involute curve (virtual line) extending from a base circle (virtual circle). Here, an involute angle of the fixed wrap 512 indicates an angle that is around a center (fixed spiral center) of the base circle of the fixed wrap 512, that is, an angle from a reference point (start point of the involute curve) of the base circle to the winding terminal end portion 51*c* (see FIG. 7) of the fixed wrap 512.

In the present embodiment, the involute angle of the fixed wrap 512 and the involute angle of the orbiting wrap 522 are equal. However, the involute angle of the fixed wrap 512 and the involute angle of the orbiting wrap 522 may be unequal.

In the present embodiment, the fixed wrap 512 is formed such that the center of the base circle of the fixed wrap 512 is eccentric with respect to the center (not illustrated) of the fixed base plate 511. Also, the orbiting wrap 522 is formed such that the center 52*b* of the base circle 52*a* of the orbiting wrap 522 is eccentric with respect to the center (not illustrated) of the orbiting base plate 521. This configuration makes it possible to reduce the outer diameter of the scroll unit 50, reduce the shell diameter of the scroll compressor 10, and reduce the size of the scroll compressor 10.

The orbiting scroll 52 is driven by the rotary shaft 30 via a crank mechanism 70 and is configured to revolve with respect to the fixed scroll 51, in other words, orbit around the axial center of the fixed scroll 51.

The crank mechanism 70 couples the rotary shaft 30 with the orbiting scroll 52 and converts the rotary motion of the rotary shaft 30 into the orbiting motion of the orbiting scroll 52. In the present embodiment, the crank mechanism 70 is disposed inside the hollow projection portion 233 of the second partition wall portion 232 of the center housing 23. The crank mechanism 70 includes a crankpin 71 erected on the rear end portion of the rotary shaft 30, an eccentric bush 72 attached eccentrically to the crankpin 71, and a cylindrical portion 73 formed to protrude on the back surface of the orbiting base plate 521 of the orbiting scroll 52. The eccentric bush 72 is rotatably supported on an inner peripheral surface of the cylindrical portion 73 via a bearing (not shown). In addition, a balance weight 74 that counteracts the centrifugal force generated by the revolution of the orbiting scroll 52 is attached to the rear end portion of the rotary shaft 30.

The scroll unit 50 is configured to draw and compress the low-pressure gaseous refrigerant by revolving the orbiting scroll 52 with respect to the fixed scroll 51. A thrust plate 80 having an annular disk shape is disposed between the orbiting base plate 521 of the orbiting scroll 52 and the second partition wall portion 232 of the center housing 23. A rear-side surface of the second partition wall portion 232 is configured to receive the thrust force from the orbiting scroll 52 via the thrust plate 80.

The orbiting scroll 52 can be prevented from rotation by an anti-rotation mechanism 300. Here, the anti-rotation mechanism 300 is described referring to FIGS. 3 and 4.

Figure 3:
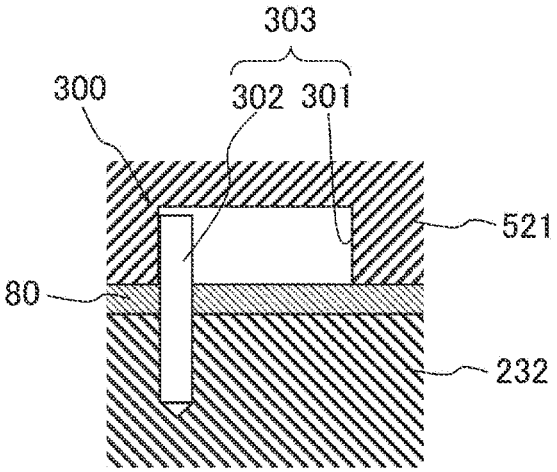
FIG. 3 is an enlarged cross-sectional view of rotation prevention parts constituting an anti-rotation mechanism.
Figure 4:
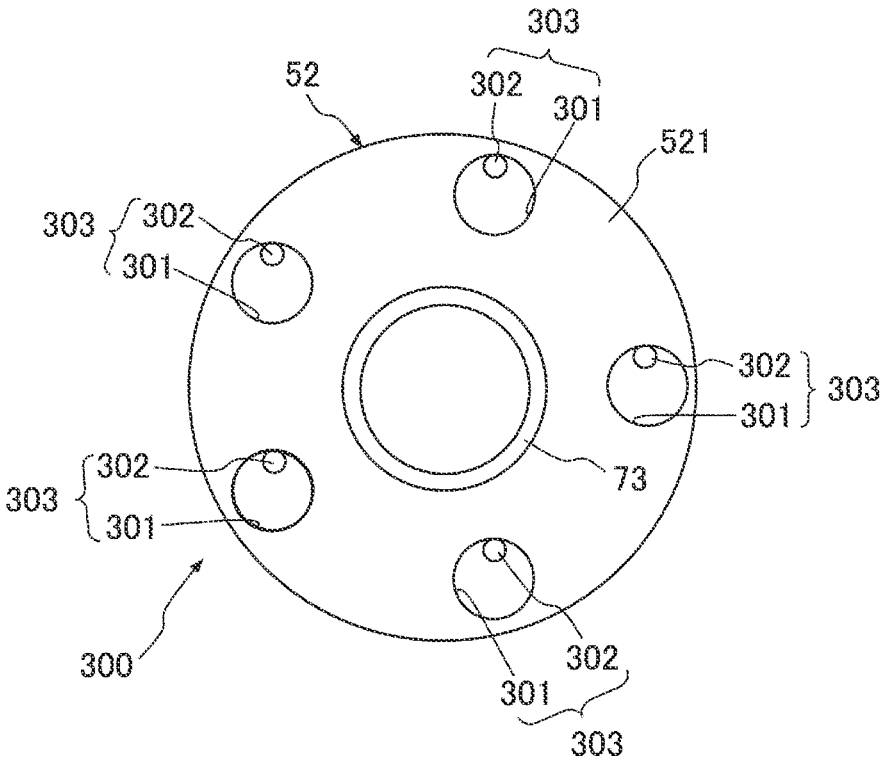
FIG. 4 is a drawing illustrating a layout of the rotation prevention parts of the anti-rotation mechanism on an orbiting base plate.

FIG. 3 is an enlarged view of rotation prevention parts 303 consisting of the anti-rotation mechanism 300. FIG. 4 is a drawing illustrating a layout of the rotation prevention parts 303 of the anti-rotation mechanism 300 on the orbiting base plate 521.

As illustrated in FIG. 3, each of the rotation prevention parts 303 includes a ring 301 that is press-fit into a circular hole formed in the back surface of the orbiting base plate 521, which is the other surface of the orbiting base plate 521, and a pin 302 that protrudes from the second partition wall portion 232 of the center housing 23, penetrates through the thrust plate 80, and is loosely fit inside the ring 301. As illustrated in FIG. 4, the anti-rotation mechanism 300 is constituted by multiple rotation prevention parts 303 (five rotation prevention parts 303 in the present embodiment) that are arranged at regular intervals along the circumferential direction near the outer edge of the back surface of the orbiting base plate 521. Here, at least three rotation prevention parts 303 are necessary to prevent the orbiting scroll 52 from rotating, while enabling the orbiting scroll 52 to revolve around the axial center of the fixed scroll 51. Here, the second partition wall portion 232 is an example of a "housing wall" of the present invention.

Returning to FIG. 1, in the present embodiment, the scroll compressor 10 includes an intake chamber H1 into which the low-pressure gaseous refrigerant flows, a compression chamber H2 in which the low-pressure gaseous refrigerant is compressed, a discharge chamber H3 into which the gaseous refrigerant compressed in the compression chamber H2 is discharged, a gas-liquid separation chamber H4 in which lubricant is separated from the gaseous refrigerant compressed in the compression chamber H2, and a back pressure chamber H5 formed on the back surface side of the orbiting scroll 52 (on the back surface side of the orbiting base plate 521).

The intake chamber H1 is defined and formed by the first peripheral wall portion 211 of the front housing 21, the first partition wall portion 212 of the front housing 21, the second peripheral wall portion 231 of the center housing 23, and the second partition wall portion 232 of the center housing 23. That is, in the present embodiment, the intake chamber H1 is formed by the motor storage space of the front housing 21 and the connection space of the center housing 23. An intake port P1 is formed in the first peripheral wall portion 211. The intake port P1 is connected to (the low-pressure side of) the refrigerant circuit via, for example, a connection pipe (not shown). Thus, low-pressure refrigerant flows from the refrigerant circuit into the intake chamber H1 via the intake port P1. In addition, the center housing 23 includes a refrigerant passage L1 for guiding the low-pressure gaseous refrigerant in the intake chamber H1 to a space H6 near an outer end portion of the scroll unit 50.

The compression chamber H2 is formed in the scroll unit 50, that is, between the fixed scroll 51 and the orbiting scroll 52. The scroll unit 50 is adapted to draw low-pressure gaseous refrigerant when forming the compression chamber H2 and to compress the low-pressure gaseous refrigerant.

Figure 10:
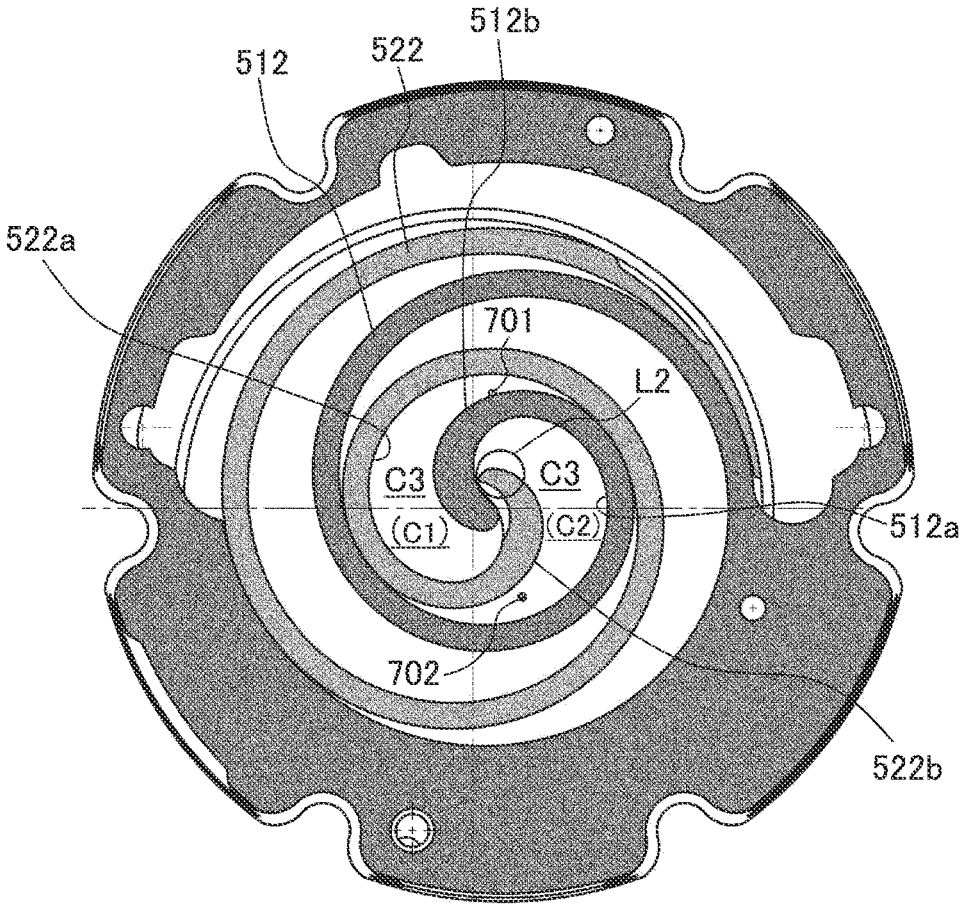
FIG. 10 is a drawing illustrating an operating state of the scroll compressor.
Figure 11:
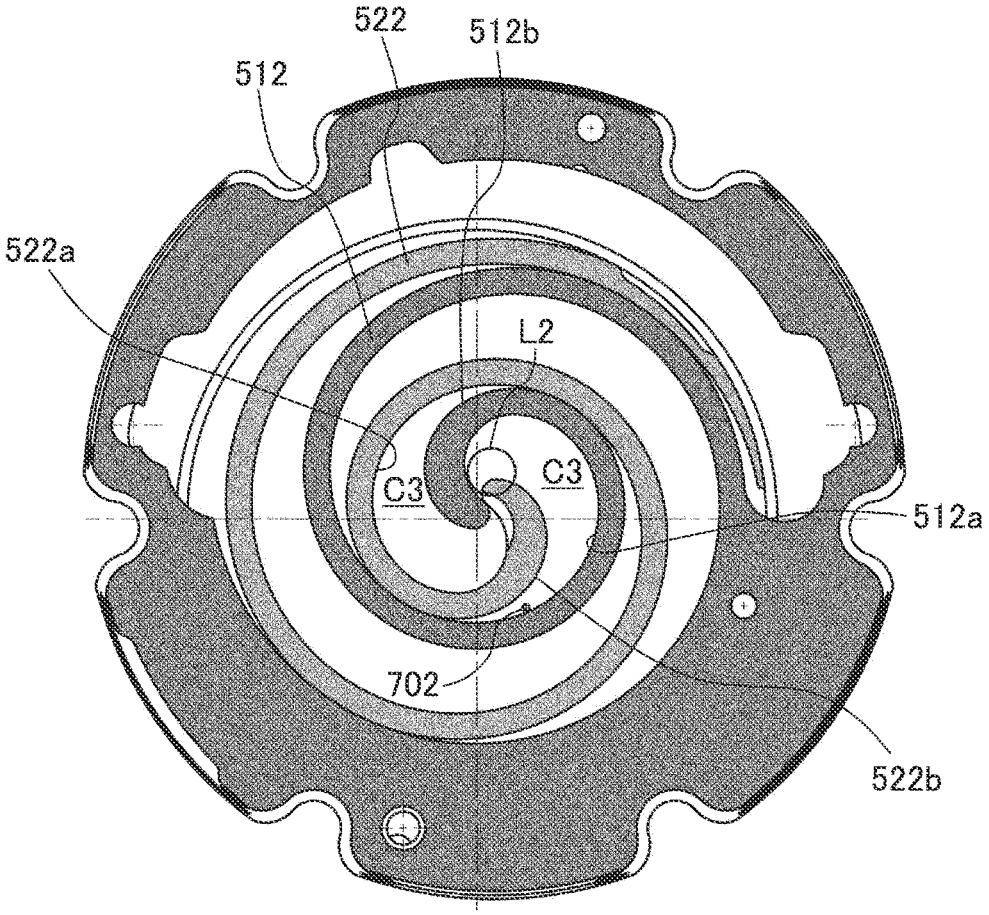
FIG. 11 is a drawing illustrating an operating state of the scroll compressor.
Figure 12:
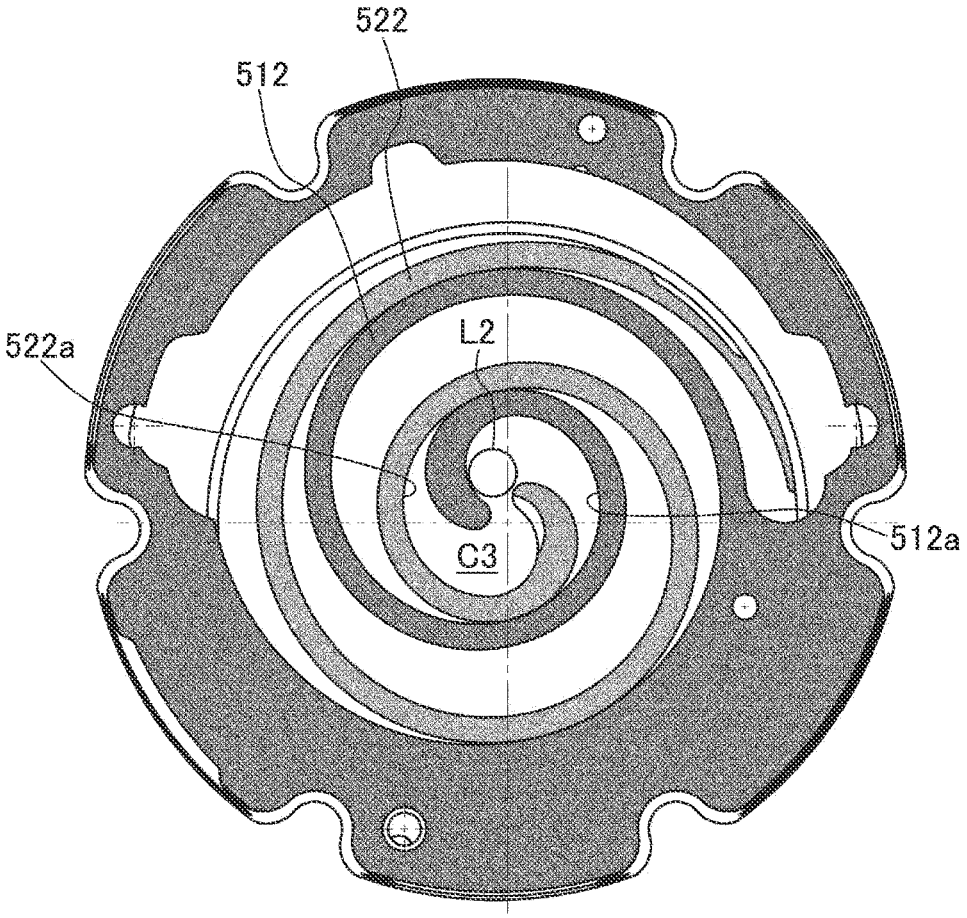
FIG. 12 is a drawing illustrating an operating state of the scroll compressor.

In the present embodiment, the fixed scroll 51 and the orbiting scroll 52 are disposed such that the circumferential angles of the fixed wrap 512 and the orbiting wrap 522 are offset from each other and wall surfaces of the fixed wrap 512 and the orbiting wrap 522 are partially in contact with each other. With this configuration of the present embodiment, as illustrated in FIGS. 2 and 7 to 10, a crescent-shaped first compression chamber C1 is formed by an inner wall surface 522*a* of the orbiting wrap 522 and an outer wall surface 512*b* of the fixed wrap 512, and a crescent-shaped second compression chamber C2 is formed by an inner wall surface 512*a* of the fixed wrap 512 and an outer wall surface 522*b* of the orbiting wrap 522. The first compression chamber C1 and the second compression chamber C2 are combined and integrated to form a final compression chamber C3 as illustrated in FIGS. 10 to 12. In the present embodiment, the first compression chamber C1, the second compression chamber C2, and the final compression chamber C3 may form the above-described compression chamber H2.

The orbiting scroll 52 is attached such that the center (axial center) of the orbiting base plate 521 is eccentric with respect to the center (axial center) of the fixed base plate 511 and is caused by the rotary shaft 30 via the crank mechanism 70 to revolve around the center of the fixed base plate 511 while being prevented from rotating by the anti-rotation mechanism 300. The radius of the revolution may be determined by a contact between the fixed wrap 512 and the orbiting wrap 522. As a result of the revolution, the first compression chamber C1 and the second compression chamber C2 move from the winding terminal end 52*c* of the orbiting wrap 522 and the winding terminal end 51*c* of the fixed wrap 512 toward the center, and the volume of the first compression chamber C1 and the volume of the second compression chamber C2 decrease. Accordingly, a gaseous refrigerant taken into the first compression chamber C1 from the winding terminal end 52*c* side of the orbiting wrap 522 is compressed, and a gaseous refrigerant taken into the second compression chamber C2 from the winding terminal end 51*c* side of the fixed wrap 512 is compressed. The gaseous refrigerant compressed in the first compression chamber C1 and the gaseous refrigerant compressed in the second compression chamber C2 are mixed together in the final compression chamber C3, which is formed of the first compression chamber C1 and the second compression chamber C2 being combined and integrated with each other.

The discharge chamber H3 shown in FIG. 1 is formed by the third peripheral wall portion 241 of the rear housing 24, the bottom wall portion 242 of the rear housing 24, and the fixed base plate 511 of the fixed scroll 51. That is, the inside of the third peripheral wall portion 241 of the rear housing 24 constitutes the discharge chamber H3. A discharge hole L2 is formed in a radially center portion of the fixed base plate 511 of the fixed scroll 51. This discharge hole L2 communicates with the compression chamber H2 (final compression chamber C3) that has moved to the innermost portion (that has reached its minimum capacity) and the discharge chamber H3. Thus, the gaseous refrigerant compressed in the compression chamber H2 (final compression chamber C3) of the scroll unit 50 is discharged into the discharge chamber H3 through the discharge hole L2. A check valve 90, e.g., a reed valve, is attached to the other surface of the fixed base plate 511 of the fixed scroll 51, the other surface facing the discharge chamber H3. This check valve 90 allows the flow of the gaseous refrigerant from the compression chamber H2 (final compression chamber C3) to the discharge chamber H3, but regulates the flow of the gaseous refrigerant from the discharge chamber H3 to the compression chamber H2 (final compression chamber C3).

The gas-liquid separation chamber H4 is formed in the rear housing 24. Specifically, in the present embodiment, the gas-liquid separation chamber H4 is formed as a cylindrical space that extends downward from an outer peripheral surface of the bottom wall portion 242 of the rear housing 24 to the inside. The gas-liquid separation chamber H4 includes an oil separator 100 that separates lubricant from the gaseous refrigerant. Although a centrifugal oil separator is used in the present embodiment, it is not to limited to this, and a different kind of oil separator may alternatively be used. A discharge port P2 is formed above the oil separator 100 in the gas-liquid separation chamber H4. The discharge port P2 is connected to (the high-pressure side of) the refrigerant circuit via, for example, a connection pipe (not shown). In addition, a communication hole L3 that communicates the discharge chamber H3 and the gas-liquid separation chamber H4 is formed in the bottom wall portion 242 of the rear housing 24.

Thus, the gaseous refrigerant in the discharge chamber H3, that is, the gaseous refrigerant (the high-pressure gaseous refrigerant) compressed in the compression chamber H2, flows into the gas-liquid separation chamber H4 via the communication hole L3. Next, lubricant is separated from the gaseous refrigerant by the oil separator 100, and then the gaseous refrigerant is guided to the high-pressure side of the refrigerant circuit through the discharge port P2. In addition, the lubricant separated from the high-pressure gaseous refrigerant by the oil separator 100 is guided to the bottom portion of the gas-liquid separation chamber H4 by gravity.

The back pressure chamber H5 is formed between the orbiting base plate 521 of the orbiting scroll 52 and the second partition wall portion 232 of the center housing 23. In the present embodiment, the back pressure chamber H5 includes an internal space of the hollow projection portion 233 of the second partition wall portion 232. A lubricant passage L4 that connects the back pressure chamber H5 and the gas-liquid separation chamber H4 is formed in the center housing 23, the fixed base plate 511 of the fixed scroll 51, and the rear housing 24. An orifice (a restriction portion) OL1 is disposed midway of the lubricant passage L4. Thus, the lubricant (including the lubricant temporarily stored on the bottom portion of the gas-liquid separation chamber H4) separated from the high-pressure gaseous refrigerant by the oil separator 100 in the gas-liquid separation chamber H4 is supplied to the back pressure chamber H5 through the lubricant passage L4.

In the present embodiment, as shown in FIG. 2, a first through hole 701 and a second through hole 702 are formed in the orbiting base plate 521 of the orbiting scroll 52. The first through hole 701 is penetratingly formed in the orbiting base plate 521 at a position capable of communicating the first compression chamber C1 with the back pressure chamber H5. The second through hole 702 is penetratingly formed in the orbiting base plate 521 at a position capable of communicating the second compression chamber C2 with the back pressure chamber H5. The first through hole 701 opens near the inner wall surface 522*a* of the orbiting wrap 522 of the orbiting base plate 521, whereas the second through hole 702 opens near the outer wall surface 522*b* of the orbiting wrap 522 of the orbiting base plate 521.

Figure 5:
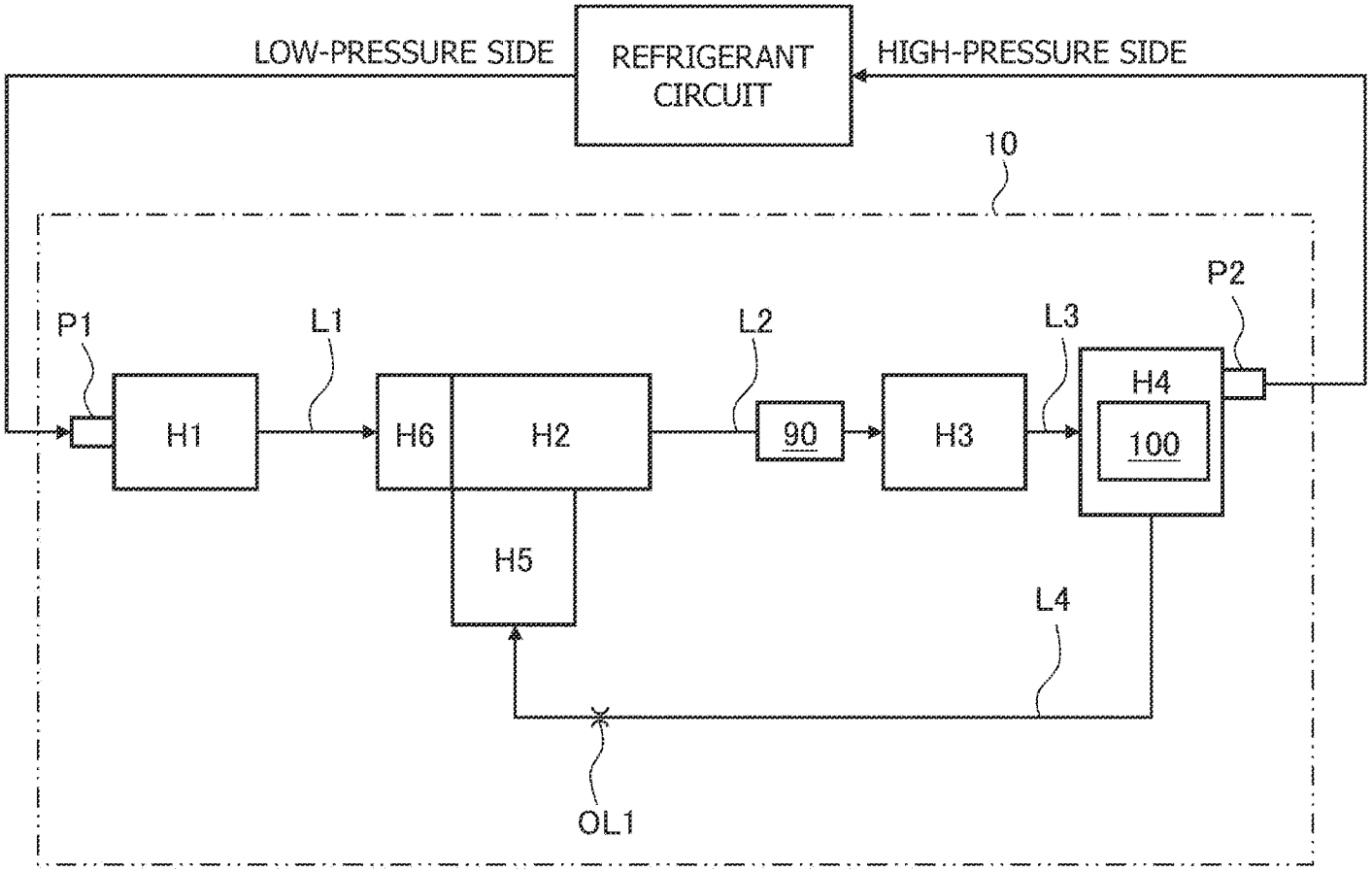
FIG. 5 is a block diagram illustrating the flow of gaseous refrigerant and lubricant in the scroll compressor.

Next, the flow of gaseous refrigerant and lubricant in the scroll compressor 10 will be described with reference to FIGS. 1 and 5. FIG. 5 is a block diagram illustrating the flow of the gaseous refrigerant and lubricant in the scroll compressor 10. In FIG. 1, flow of gaseous refrigerant which has not been mixed with lubricant, or flow of gaseous refrigerant from which lubricant has been separated out, is indicated by a hatched arrow; flow of gaseous refrigerant including lubricant is indicated by a black arrow, and flow of lubricant separated out from the gaseous refrigerant is indicated by a white arrow.

As illustrated in FIGS. 1 and 5, the low-pressure gaseous refrigerant from the refrigerant circuit flows into the intake chamber H1 via the intake port P1 and is then guided to the space H6 located near the outer end portion of the scroll unit 50 through the refrigerant passage L1. After being guided to the space H6, the low-pressure gaseous refrigerant is drawn into and compressed in the compression chamber H2 (first compression chamber C1, second compression chamber C2, and final compression chamber C3) of the scroll unit 50 due to the revolution of the orbiting scroll 52. The gaseous refrigerant (high-pressure gaseous refrigerant) compressed in the compression chamber H2 is discharged into the discharge chamber H3 through the discharge hole L2 (and the check valve 90) and then flows into the gas-liquid separation chamber H4 via the communication hole L3. After the gaseous refrigerant flows into the gas-liquid separation chamber H4, the lubricant contained in the gaseous refrigerant is separated from the gaseous refrigerant by the oil separator 100. Next, the gaseous refrigerant separated from the lubricant by the oil separator 100 is guided to the refrigerant circuit through the discharge port P2. In addition, the lubricant separated from the gaseous refrigerant by the oil separator 100 flows from the bottom portion of the gas-liquid separation chamber H4 through the lubricant passage L4 and is supplied to the back pressure chamber H5. The back pressure chamber H5 can communicate with the compression chamber H2 (first compression chamber C1, second compression chamber C2, and final compression chamber C3) via the first through hole 701 and the second through hole 702.

Here, the orifice OL1 is disposed midway of the lubricant passage L4. Thus, the lubricant separated from the gaseous refrigerant by the oil separator 100 is decompressed from the pressure Pd in the discharge chamber H3 to be supplied to the back pressure chamber H5. In addition, the back pressure chamber H5 can communicate with the compression chamber H2 (first compression chamber C1, second compression chamber C2, and final compression chamber C3) via the first through hole 701 and the second through hole 702. Thus, due to the first through hole 701 and the second through hole 702, which can function as restriction portions, the flow rate of the fluid (lubricant and/or the gaseous refrigerant) that flows between the back pressure chamber H5 and the compression chamber H2 (first compression chamber C1, second compression chamber C2, and final compression chamber C3) is restricted. As a result, the pressure in the back pressure chamber H5 is maintained at a medium pressure (back pressure) Pm between a pressure Ps in the intake chamber H1 and the pressure Pd in the discharge chamber H3, and this medium pressure (back pressure) Pm presses the orbiting scroll 52 toward the fixed scroll 51. That is, the back pressure chamber H5 applies the back pressure Pm, which presses the orbiting scroll 52 toward the fixed scroll 51, to the orbiting scroll 52. In other words, the back pressure chamber H5 can generate the back pressure Pm that presses and biases the orbiting scroll 52 toward the fixed scroll 51.

The first through hole 701 and the second through hole 702 can function as back pressure controlling holes for controlling the back pressure Pm.

Figure 6:
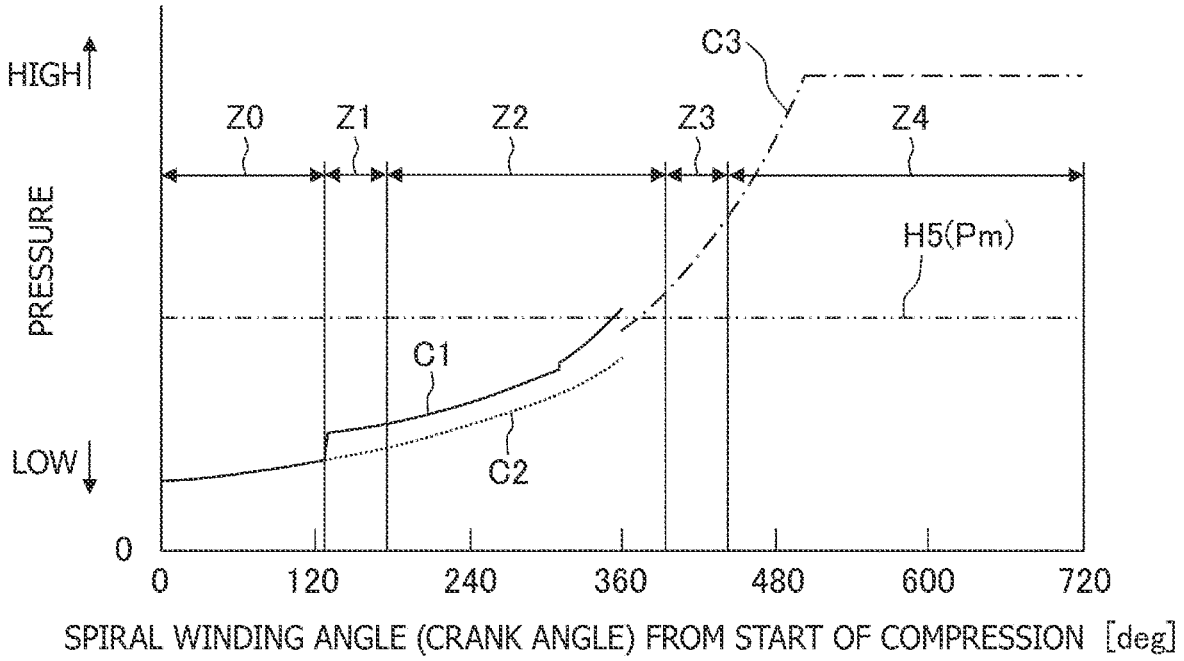
FIG. 6 is a drawing illustrating a relationship between pressures in compression chambers and a back pressure chamber, and a spiral winding angle (crank angle).

The operation of the scroll compressor 10 with the above configuration is described below referring to FIGS. 6 to 12. FIG. 6 illustrates a relationship between pressures in the first compression chamber C1, the second compression chamber C2, and the final compression chamber C3, a pressure in the back pressure chamber H5 (back pressure Pm), and the spiral winding angle (crank angle) from the start of the compression of the gaseous refrigerant in the compression chamber H2 (first compression chamber C1 and second compression chamber C2). FIGS. 7 to 12 illustrates operating states of the scroll compressor 10.

When the rotary shaft 30 is rotated by a rotational driving force from the electric motor 40, the orbiting scroll 52 is caused by the crank mechanism 70 to revolve around the axial center of the fixed scroll 51 while being prevented from rotating by the anti-rotation mechanism 300. As a result of the revolution of the orbiting scroll 52, the gaseous refrigerant is taken into the first compression chamber C1 and the second compression chamber C2 between the fixed wrap 512 and the orbiting wrap 522 of the scroll unit 50 from the intake port P1 via the intake chamber H1, the refrigerant passage L1, and the space H6.

Figure 7:
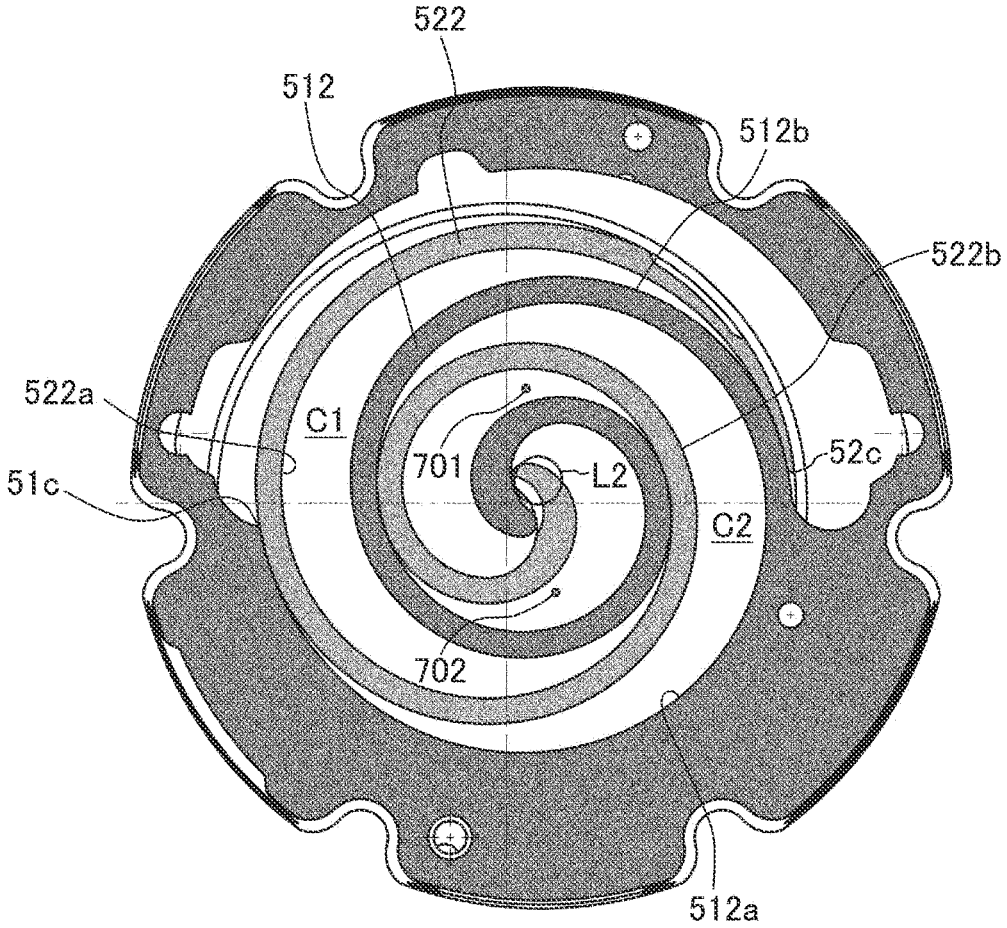
FIG. 7 is a drawing illustrating an operating state of the scroll compressor.
Figure 8:
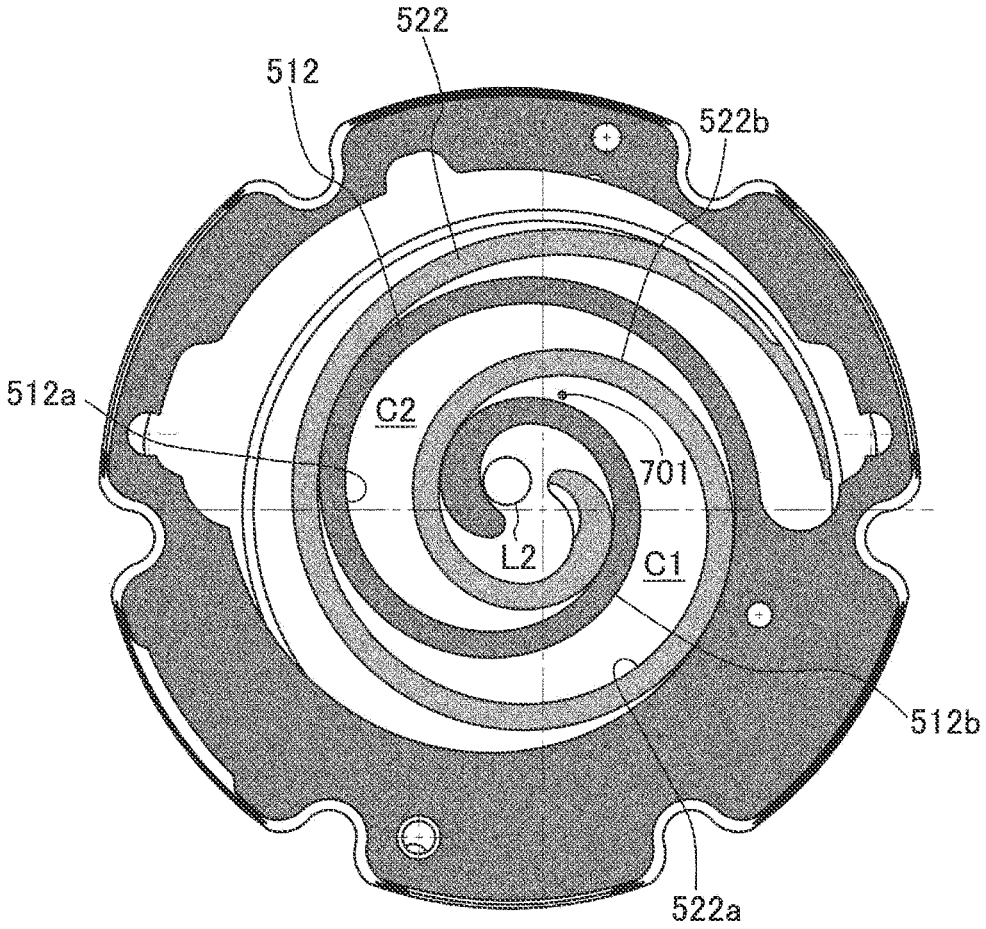
FIG. 8 is a drawing illustrating an operating state of the scroll compressor.
Figure 9:
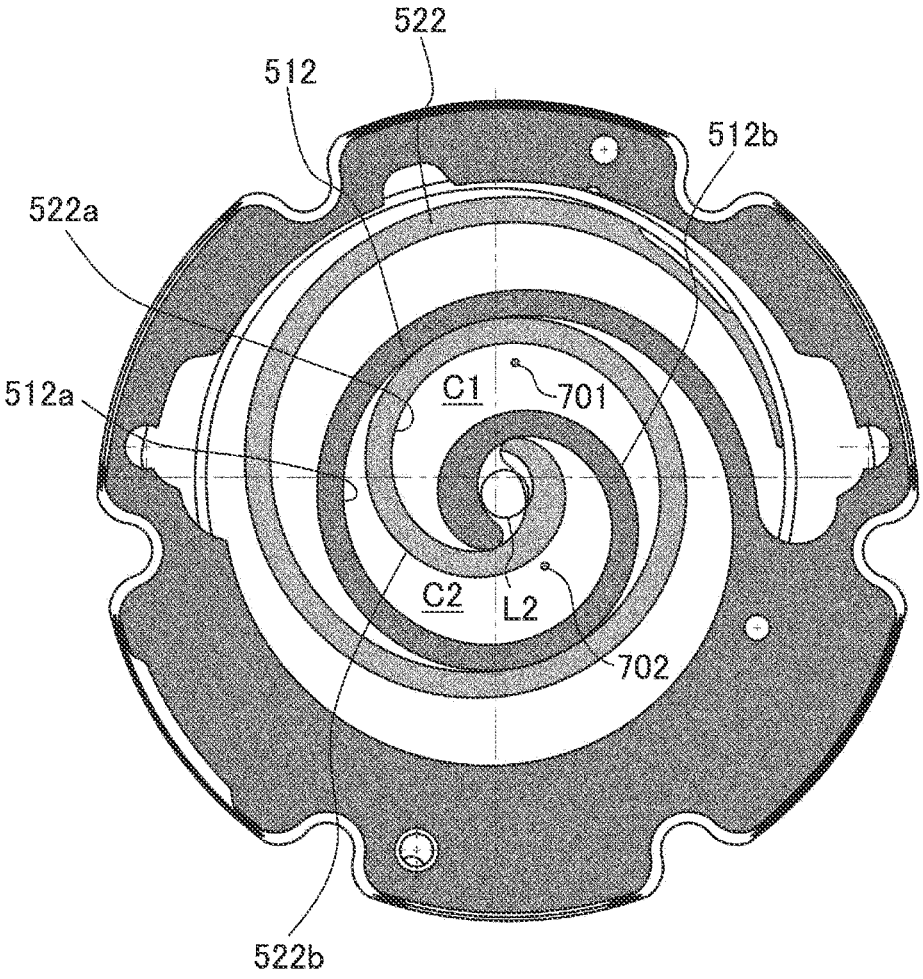
FIG. 9 is a drawing illustrating an operating state of the scroll compressor.

In the present embodiment, the involute angle to the winding terminal end 51*c* of the fixed wrap 512 and the involute angle to the winding terminal end 52*c* of the orbiting wrap 522 are equal. Thus, as shown in FIG. 7, the winding terminal end 52*c* of the orbiting wrap 522 contacts the outer wall surface 512*b* of the fixed wrap 512 and the first compression chamber C1 is thereby sealed. At the same time, the winding terminal end 51*c* of the fixed wrap 512 contacts the outer wall surface 522*b* of the orbiting wrap 522 and the second compression chamber C2 is thereby sealed. Note that the state in FIG. 7 corresponds to the state at a crank angle of 0° in FIG. 6.

During the period Z0 shown in FIG. 6, as a result of the revolution of the orbiting scroll 52, the volume of the first compression chamber C1 decreases to increase the internal pressure of the first compression chamber C1, and the volume of the second compression chamber C2 decreases to increase the internal pressure of the second compression chamber C2. During the period Z0, as shown in FIG. 7, the first through hole 701 is at a position away from the first compression chamber C1 and the second through hole 702 is at a position away from the second compression chamber C2.

Next, at the transition point from the period Z0 to the period Z1 in FIG. 6, the first through hole 701 shifts away from the protruding end of the fixed wrap 512, which has closed the first through hole 701, and the first through hole 701 thereby opens. The communication between the first compression chamber C1 and the back pressure chamber H5 via the first through hole 701 starts at this point (see FIG. 8). The first through hole 701 is maintained in an opened state during the periods Z1 and Z2 in FIG. 6. On the other hand, the second through hole 702 is at a position away from the second compression chamber C2 during the period Z1. Here, during the period Z1, the pressure in the back pressure chamber H5 (back pressure Pm) is higher than the pressure in the first compression chamber C1. Accordingly, because the fluid in the back pressure chamber H5 flows from the back pressure chamber H5 into the first compression chamber C1 via the first through hole 701, the pressure in the first compression chamber C1 becomes correspondingly higher than the pressure in the second compression chamber C2. Here, it is needless to say that, during the period Z1 as well, as a result of the revolution of the orbiting scroll 52, the volume of the first compression chamber C1 decreases to increase the internal pressure of the first compression chamber C1, and the volume of the second compression chamber C2 decreases to increase the internal pressure of the second compression chamber C2.

During the period Z1, the pressure in the first compression chamber C1 is maintained higher than the pressure in the second compression chamber C2. Thus, the rotational moment generated in the orbiting scroll 52 can be increased correspondingly. Here, the direction of the rotational moment corresponds to the direction of the revolution of the orbiting scroll 52.

Next, at the transition point from the period Z1 to the period Z2 in FIG. 6, the second through hole 702 shifts away from the protruding end of the fixed wrap 512, which has closed the second through hole 702, and the second through hole 702 thereby opens. The communication between the second compression chamber C2 and the back pressure chamber H5 via the second through hole 702 starts at this point (see FIG. 9). The second through hole 702 is maintained in an opened state during the periods Z2 and Z3 in FIG. 6.

At a crank angle of 360° in the middle of the period Z2, the gaseous refrigerant compressed as a result of the reduction in the volume of the first compression chamber C1 caused by the revolution of the orbiting scroll 52 and the gaseous refrigerant compressed as a result of the reduction in the volume of the second compression chamber C2 are mixed in the third compression chamber C3 as illustrated in FIG. 10. During the period from the start point of the period Z2 to the point at which the crank angle is 360°, the magnitude relationship between the pressure in the first compression chamber C1 and the pressure in the second compression chamber C2 is maintained as in the period Z1. Here, it is needless to say that, during the period from the start point of the period Z2 to the point at which the crank angle is 360° as well, as a result of the revolution of the orbiting scroll 52, the volume of the first compression chamber C1 decreases to increase the internal pressure of the first compression chamber C1, and the volume of the second compression chamber C2 decreases to increase the internal pressure of the second compression chamber C2. Accordingly, during the period from the start point of the period Z2 to the point at which the crank angle is 360°, the pressure in the first compression chamber C1 is maintained higher than the pressure in the second compression chamber C2. Thus, the rotational moment generated in the orbiting scroll 52 can be increased correspondingly. Here, the direction of the rotational moment corresponds to the direction of the revolution of the orbiting scroll 52.

During the period from the start point of the period Z2 to the point at which the crank angle is 360°, the pressure in the back pressure chamber H5 (back pressure Pm) is higher than the pressure in the second compression chamber C2. Accordingly, because the fluid in the back pressure chamber H5 flows from the back pressure chamber H5 into the second compression chamber C2 via the second through hole 702, the pressure in the second compression chamber C2 increases correspondingly. The same applies to the first compression chamber C1.

After the point at which the crank angle is 360° in the period Z2, as a result of the revolution of the orbiting scroll 52, the volume of the final compression chamber C3 decreases to increase the internal pressure of the final compression chamber C3.

Next, at the transition point from the period Z2 to the period Z3 in FIG. 6, the first through hole 701 is closed by the protruding end of the fixed wrap 512. That is, the communication between the final compression chamber C3 and the back pressure chamber H5 via the first through hole 701 is blocked at this point (see FIG. 11). After this point, the first through hole 701 is at a position away from the final compression chamber C3. On the other hand, during the period Z3, the second through hole 702 is maintained in an opened state, and thus, the final compression chamber C3 and the back pressure chamber H5 continue communicating with each other via the second through hole 702.

Next, at the transition point from the period Z3 to the period Z4 in FIG. 6, the second through hole 702 is closed by the protruding end of the fixed wrap 512. That is, the communication between the final compression chamber C3 and the back pressure chamber H5 via the second through hole 702 is blocked at this point (see FIG. 12). After this point, the second through hole 702 is at a position away from the final compression chamber C3.

Here, during the period Z2, when the pressure in the final compression chamber C3 is higher than the pressure in the back pressure chamber H5 (back pressure Pm), the fluid in the final compression chamber C3 may flow into the back pressure chamber H5 via both of the first through hole 701 and the second through hole 702. In addition, during the period Z3, because the pressure in the final compression chamber C3 is higher than the pressure in the back pressure chamber H5 (back pressure Pm), the fluid in the compression chamber C3 may flow into the back pressure chamber H5 via the second through hole 702.

Accordingly, during the period Z1 in FIG. 6, the first compression chamber C1 communicates with the back pressure chamber H5 via the first through hole 701, whereas the second compression chamber C2 and the back pressure chamber H5 do not communicate with each other. During the period from the start point of the period Z2 to the point at which the crank angle is 360°, the first compression chamber C1 communicates with the back pressure chamber H5 via the first through hole 701 and the second compression chamber C2 communicates with the back pressure chamber H5 via the second through hole 702. During the period from the point at which the crank angle is 360° to the finish point of the period Z2, the final compression chamber C3 communicates with the back pressure chamber H5 via the first through hole 701 and the second through hole 702. During the period Z3, the final compression chamber C3 communicates with the back pressure chamber H5 via the second through hole 702, whereas the first compression chamber C1 and the back pressure chamber H5 are uncommunicated with each other.

When the revolution of the orbiting scroll 52 reduces the volume of the final compression chamber C3 to allow the pressure in the final compression chamber C3 to reach a discharge pressure, the check valve 90 opens, and the gaseous refrigerant in the final compression chamber C3 is discharged through the discharge hole L2 into the discharge chamber H3.

As described above, in the scroll compressor 10 of the present embodiment, the center of the orbiting base plate 521 and the center 52*b* of the base circle 52*a* of the orbiting wrap 522 are eccentric from each other. With this configuration, a distance α (not shown) between the center of the compression reaction force applied to the orbiting scroll 52 and the center of the orbiting base plate 521 varies during one revolution of the orbiting scroll 52. The center of the compression reaction force applied to the orbiting scroll 52 is at the midpoint between the center of the base circle of the fixed wrap 512 and the center 52*b* of the base circle 52*a* of the orbiting wrap 522 when the pressure in the first compression chamber C1 is the same as the pressure in the second compression chamber C2. As the pressure in the first compression chamber C1 becomes higher than the pressure in the second compression chamber C2, the center of the compression reaction force moves further away from the center of the orbiting base plate 521 (in other words, the distance α increases); and in the opposite case, the center of the compression reaction force moves closer to the center of the orbiting base plate 521 (in other words, the distance α decreases). Here, the aforementioned rotational moment indicates a moment around the center of the orbiting base plate 521 and is the product of the compression reaction force and the distance α. The compression reaction force varies during one revolution of the orbiting scroll 52 and is minimum, for example, when the crank angle shown in FIG. 6 is about 360°. Thus, in order to suppress the reduction of the rotational moment at a crank angle of about 360° at which the compression reaction force becomes smallest, it is preferable that the pressure in the first compression chamber C1 is made much higher than the pressure in the second compression chamber C2 at the crank angle of about 360° so as to increase the distance α at the crank angle of about 360°.

Thus, the below described measure [1] is adopted in the present embodiment.

[1] As illustrated in FIGS. 6 to 9, the first compression chamber C1 communicates with the back pressure chamber H5 via the first through hole 701 prior to the communication of the second compression chamber C2 with the back pressure chamber H5 via the second through hole 702. As a result, for example during the period Z1 and the period from the start point of the period Z2 to the point at which the crank angle is 360° as shown in FIG. 6, the difference between the pressure in the first compression chamber C1 and the pressure in the second compression chamber C2 can increase, thereby suppressing the reduction of the rotational moment.

Adopting such measures makes it possible to suppress the reduction of the rotational moment, for example, when the crank angle shown in FIG. 6 is about 360° and thereby makes it possible to cause the pin 302 to be properly in contact with an inner peripheral surface of the ring 301. This in turn makes it possible to prevent the pin 302 from colliding with the ring 301 and thereby makes it possible to reduce the occurrence of vibration and noise in the anti-rotation mechanism 300.

Moreover, in the present embodiment, the below described additional measure [2] may be adopted.

[2] The involute angle ending at the winding terminal end 51*c* of the fixed wrap 512 is made less than the involute angle ending at the winding terminal end 52*c* of the orbiting wrap 522. With this configuration, after the winding terminal end 52*c* of the orbiting wrap 522 contacts the outer wall surface 512*b* of the fixed wrap 512 and the first compression chamber C1 is thereby closed, the winding terminal end 51*c* of the fixed wrap 512 contacts the outer wall surface 522*b* of the orbiting wrap 522 and the second compression chamber C2 is thereby closed. That is, because the first compression chamber C1 constantly compresses the gaseous refrigerant ahead of the second compression chamber C2, the pressure in the first compression chamber C1 is maintained higher than the pressure in the second compression chamber C2. This makes it possible to raise the level of the rotational moment to be generated.

According to the present embodiment, the scroll compressor 10 includes the fixed scroll 51 including the fixed base plate 511 having the discharge hole L2 in the center of the fixed base plate 511 and the spiral fixed wrap 512 erected on the fixed base plate 511, the orbiting scroll 52 including the orbiting base plate 521 and the spiral orbiting wrap 522 that is erected on the orbiting base plate 521 and is meshed with the fixed wrap 512, the first compression chamber C1 formed by the inner wall surface 522*a* of the orbiting wrap 522 and the outer wall surface 512*b* of the fixed wrap 512, the second compression chamber C2 formed by the inner wall surface 512*a* of the fixed wrap 512 and the outer wall surface 522*b* of the orbiting wrap 522, the anti-rotation mechanism 300 that prevents the rotation of the orbiting scroll 52, and the back pressure chamber H5 formed on the back surface side of the orbiting scroll 52. The scroll compressor 10 is configured such that the orbiting scroll 52 is caused to revolve (orbit) around the axial center of the fixed scroll 51 while the rotation of the orbiting scroll 52 is prevented by the anti-rotation mechanism 300 to change the volume of the first compression chamber C1 and the volume of the second compression chamber C2 and thereby cause the fluid (e.g., gaseous refrigerant) in the first compression chamber C1 and the fluid (e.g., gaseous refrigerant) in the second compression chamber C2 to be compressed separately and then discharged together through the discharge hole L2 into the discharge chamber H3. The orbiting base plate 521 includes the first through hole 701 capable of communicating the first compression chamber C1 with the back pressure chamber H5 and the second through hole 702 capable of communicating the second compression chamber C2 with the back pressure chamber H5. The first compression chamber C1 communicates with the back pressure chamber H5 via the first through hole 701 prior to the communication of the second compression chamber C2 with the back pressure chamber H5 via the second through hole 702. Accordingly, the pressure in the first compression chamber C1 can be maintained higher than the pressure in the second compression chamber C2. This makes it possible to correspondingly increase a rotational moment generated in the orbiting scroll 52 and thereby makes it possible to suppress the reduction of the rotational moment.

According to the present invention, as shown in FIG. 6, during a period in which the pressure in the back pressure chamber H5 is higher than the pressures in the first compression chamber C1 and the second compression chamber C2, the second compression chamber C2 starts communicating with the back pressure chamber H5 via the second through hole 702 (that is, the period Z2 is started) after the first compression chamber C1 starts communicating with the back pressure chamber H5 via the first through hole 701 (that is, after the period Z1 is started). As a result, the pressure in the first compression chamber C1 can be maintained higher than the pressure in the second compression chamber C2.

Moreover, according to the present embodiment, the anti-rotation mechanism 300 includes the ring 301 that is press-fit into the circular hole formed in one of the back surface of the orbiting base plate 521 and the housing wall (e.g., the second partition wall portion 232) facing the back surface, and the pin 302 that is protrudingly provided on another one of the back surface and the housing wall and is loosely fit inside the ring 301. This configuration makes it possible to reduce the occurrence of vibration and noise in the anti-rotation mechanism 300.

According to the present embodiment, the fixed wrap 512 may be formed according to an involute curve that is based on the base circle of the fixed wrap 512. The orbiting wrap 522 may be formed according to an involute curve that is based on the base circle 52*a* of the orbiting wrap 522. The involute angle from the reference point on the base circle of the fixed wrap 512 to the winding terminal end 51*c* of the fixed wrap 512 is equal to the involute angle from the reference point on the base circle 52*a* of the orbiting wrap 522 to the winding terminal end 52*c* of the orbiting wrap 522. With this configuration, as shown in FIG. 7, the winding terminal end 52*c* of the orbiting wrap 522 contacts the outer wall surface 512*b* of the fixed wrap 512 and the first compression chamber C1 is thereby closed, and at the same time, the winding terminal end 51*c* of the fixed wrap 512 contacts the outer wall surface 522*b* of the orbiting wrap 522 and the second compression chamber C2 is thereby closed.

In the present embodiment, the involute angle from the reference point on the base circle of the fixed wrap 512 to the winding terminal end 51*c* of the fixed wrap 512 may be less than the involute angle from the reference point on the base circle 52*a* of the orbiting wrap 522 to the winding terminal end 52*c* of the orbiting wrap 522. In this case, the winding terminal end 51*c* of the fixed wrap 512 contacts the outer wall surface 522*b* of the orbiting wrap 522 and the second compression chamber C2 is thereby closed, after the winding terminal end 52*c* of the orbiting wrap 522 contacts the outer wall surface 512*b* of the fixed wrap 512 and the first compression chamber C1 is thereby closed. Accordingly, the pressure in the first compression chamber C1 is maintained higher than the pressure in the second compression chamber C2. This makes it possible to constantly generate a rotational moment in the orbiting scroll 52 and thereby makes it possible to suppress the reduction of the rotational moment.

Moreover, according to the present embodiment, the center of the fixed base plate 511 and the center of the base circle of the fixed wrap 512 are eccentric (shifted) from each other. Also, the center of the orbiting base plate 521 and the center 52*b* of the base circle 52*a* of the orbiting wrap 522 are eccentric from each other. This configuration of the scroll compressor 10 makes it possible to reduce the occurrence of vibration and noise in the anti-rotation mechanism 300.

A drive source for driving the scroll compressor 10 of the present embodiment is not limited to the electric motor 40, but may be, for example, a vehicle engine.

The scroll unit 50 (the fixed scroll 51 and the orbiting scroll 52) described above may also be used for a scroll expander. For example, the scroll expander may be incorporated into a refrigerant circuit of a Rankine cycle device for a vehicle and be configured to expand refrigerant introduced from the refrigerant circuit to generate power (or recover power from the refrigerant).

A preferred embodiment of the present invention is described above. However, the present invention is not limited to the above-described embodiment, and clearly, the embodiment may be further modified and changed based on the technical idea of the present invention.

REFERENCE SYMBOL LIST

10 scroll compressor
20 housing
21 front housing
23 center housing
24 rear housing
50 scroll unit
51 fixed scroll
51*c* winding terminal end
52 orbiting scroll
52*a* base circle
52*b* center
52*c* winding terminal end
100 oil separator
232 second partition wall portion (housing wall)
300 anti-rotation mechanism
301 ring
302 pin
303 rotation prevention part
511 fixed base plate
512 fixed wrap
512*a* inner wall surface
512*b* outer wall surface
521 orbiting base plate
522 orbiting wrap
522*a* inner wall surface
522*b* outer wall surface

701 first through hole
702 second through hole
C1 first compression chamber
C2 second compression chamber
C3 final compression chamber
H1 intake chamber
H2 compression chamber
H3 discharge chamber
H4 gas-liquid separation chamber
H5 back pressure chamber
H6 space
L1 refrigerant passage
L2 discharge hole
L3 communication hole
L4 lubricant passage
OL1 orifice

The invention claimed is:

1. A scroll compressor comprising:

a fixed scroll including a fixed base plate having a discharge hole in a center of the fixed base plate and a spiral fixed wrap erected on the fixed base plate;

an orbiting scroll including an orbiting base plate and a spiral orbiting wrap that is erected on the orbiting base plate and is meshed with the fixed wrap;

a first compression chamber formed by an inner wall surface of the orbiting wrap and an outer wall surface of the fixed wrap;

a second compression chamber formed by an inner wall surface of the fixed wrap and an outer wall surface of the orbiting wrap;

an anti-rotation mechanism that prevents rotation of the orbiting scroll; and a back pressure chamber formed on a back surface side of the orbiting scroll, wherein the scroll compressor is configured such that the orbiting scroll is caused to revolve around an axial center of the fixed scroll while the rotation of the orbiting scroll is prevented by the anti-rotation mechanism to change a volume of the first compression chamber and a volume of the second compression chamber and thereby cause a fluid in the first compression chamber and a fluid in the second compression chamber to be compressed separately and then discharged together through the discharge hole into a discharge chamber;

the orbiting base plate includes a first through hole capable of communicating the first compression chamber with the back pressure chamber and a second through hole capable of communicating the second compression chamber with the back pressure chamber; and the first compression chamber communicates with the back pressure chamber via the first through hole prior to a communication of the second compression chamber with the back pressure chamber via the second through hole.

2. The scroll compressor according to claim 1, wherein, during a period in which a pressure in the back pressure chamber is higher than pressures in the first compression chamber and the second compression chamber, the second compression chamber starts communicating with the back pressure chamber via the second through hole after the first compression chamber starts communicating with the back pressure chamber via the first through hole.

3. The scroll compressor according to claim 1, wherein the anti-rotation mechanism includes a ring that is press-fit into a circular hole formed in one of the back surface of the orbiting base plate and a housing wall facing the back surface, and a pin that is protrudingly provided on another one of the back surface and the housing wall and is loosely fit inside the ring.

4. The scroll compressor according to claim 1, wherein an involute angle from a reference point on a base circle of the fixed wrap to a winding terminal end of the fixed wrap is equal to an involute angle from a reference point on a base circle of the orbiting wrap to a winding terminal end of the orbiting wrap.

5. The scroll compressor according to claim 1, wherein a winding terminal end of the orbiting wrap contacts the outer wall surface of the fixed wrap and the first compression chamber is thereby closed, and at the same time, a winding terminal end of the fixed wrap contacts the outer wall surface of the orbiting wrap and the second compression chamber is thereby closed.

6. The scroll compressor according to claim 1, wherein an involute angle from a reference point on a base circle of the fixed wrap to a winding terminal end of the fixed wrap is less than an involute angle from a reference point on a base circle of the orbiting wrap to a winding terminal end of the orbiting wrap.

7. The scroll compressor according to claim 1, wherein a winding terminal end of the fixed wrap contacts the outer wall surface of the orbiting wrap and the second compression chamber is thereby closed, after a winding terminal end of the orbiting wrap contacts the outer wall surface of the fixed wrap and the first compression chamber is thereby closed.

8. The scroll compressor according to claim 1, wherein a center of the fixed base plate and a center of a base circle of the fixed wrap are eccentric from each other, and a center of the orbiting base plate and a center of a base circle of the orbiting wrap are eccentric from each other.

* * * * *